US005099904A

United States Patent [19]

Susnar

[11] Patent Number: 5,099,904

[45] Date of Patent: Mar. 31, 1992

[54] FOLDING SHUTTER PROVIDING SECURITY

[75] Inventor: Ronald S. Susnar, Sarasota, Fla.

[73] Assignee: Security Shutter Corporation, St. Venice, Fla.

[21] Appl. No.: 759,694

[22] Filed: Sep. 9, 1991

Related U.S. Application Data

[63] Continuation of Ser. No. 148,982, Jan. 27, 1988, abandoned.

[51] Int. Cl.[5] ..... E05D 15/26

[52] U.S. Cl. ..... 160/199; 160/206; 160/229.1

[58] Field of Search ..... 160/199, 196.1, 228, 160/206, 229.1; 16/270, 366, 378, 379

[56] References Cited

U.S. PATENT DOCUMENTS

| | | | |
|---|---|---|---|
| 2,351,656 | 6/1944 | Auten | 160/99 |
| 2,827,957 | 3/1958 | Haws | 160/99 |
| 3,073,382 | 1/1963 | Zimmerman | 160/183 |
| 3,205,935 | 9/1965 | Cayton | 160/183 |
| 3,924,671 | 12/1975 | Gates | 160/183 |
| 4,328,853 | 5/1982 | Gall | 160/183 |
| 4,497,357 | 2/1985 | Labelle | 160/199 |
| 4,660,613 | 4/1987 | Dagenais | 160/199 |

FOREIGN PATENT DOCUMENTS 2054711A 2/1981 United Kingdom .

*Primary Examiner*—Blair M. Johnson
*Attorney, Agent, or Firm*—John L. Harris

[57] ABSTRACT

A foldable shutter for protecting sliding glass doors from storms and break-ins is formed of vertical panels hinged together. The panels are extruded with full length beads on both sides and are held together by long extruded hinge clips having separate channels into which beads of adjacent panels fit. These hinge clips are substantially longer than the panels and the ends are closed by closure members having pins extending into the channel and spacing the panels from the ends. These closure members support the shutter on rollers in an upper guide and guide the bottom of the shutter in a lower guide. The hinges have three separate functions—to hold the panels together, to support the shutters, and to hold the shutters in place in the guides. Locking end trim sections for the shutter are hinged to the end panels and are also longer than the panels for support and guidance.

16 Claims, 2 Drawing Sheets

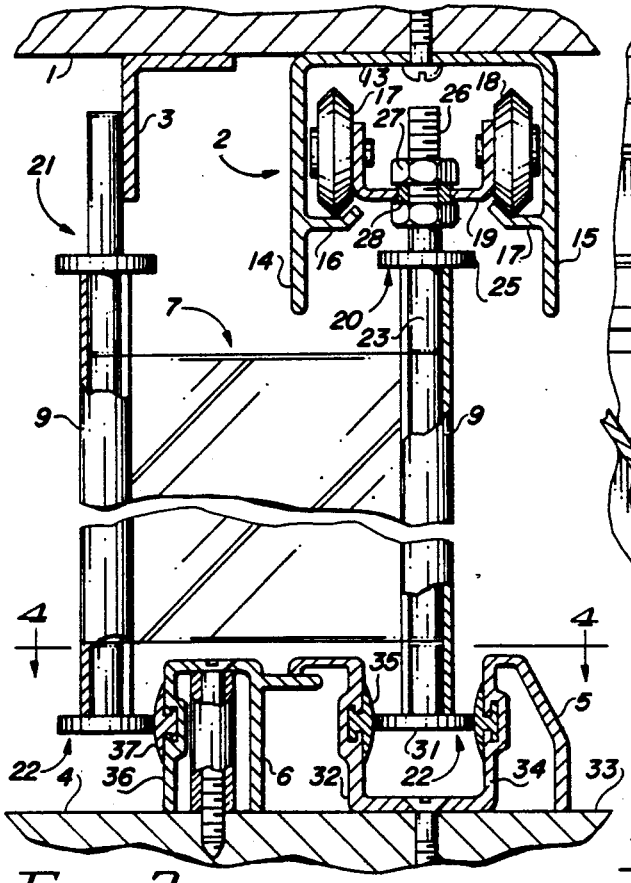
FIG. 3
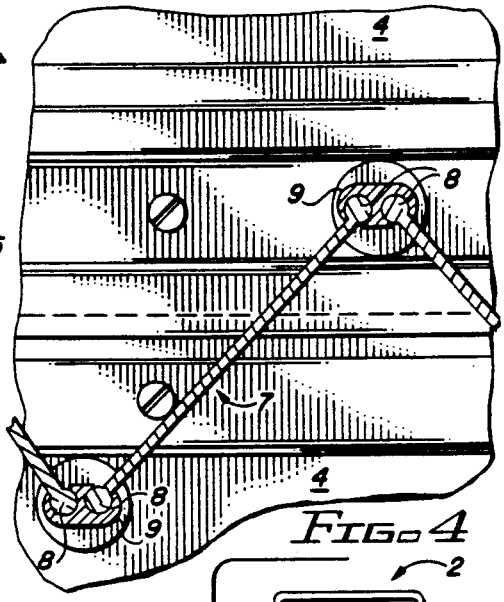
FIG. 4
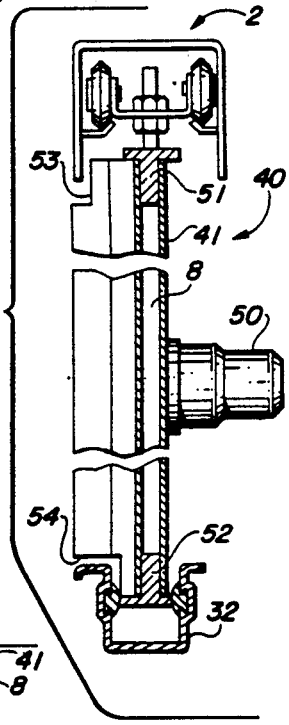
FIG. 8
FIG. 7
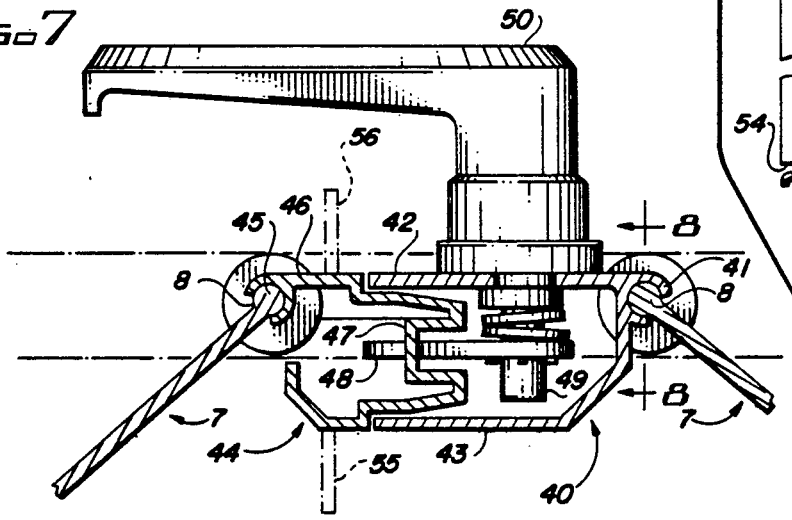
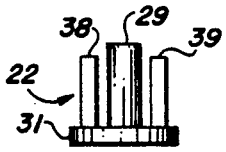
FIG. 5
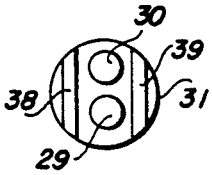
FIG. 6

FOLDING SHUTTER PROVIDING SECURITY

This is a continuation of copending application(s) Ser. No. 07/148,982 filed on Jan. 27, 1988 now abandone.

BACKGROUND OF THE INVENTION

This invention relates to foldable shutters and more particularly to external shutters for protecting outside doors and windows from stroms and break-ins.

Foldable shutters usually consist of a plurality of vertical panels hinged together and supported on rollers in an upper guide, the bottoms being guided by a lower parallel guide. In one type, the panels have mounting attachments on tops and bottoms at their midpoints so that each panel swivels about it vertical axis as the door is folded and unfolded. An example of this type is shown in Cayton, U.S. Pat. No. 3,205.573. In this patent, the plastic panels are formed with beads at opposite edges extending into full-length hinge members. The hinge members have two separate slots receiving beads from adjacent panels, holding the panels together and allowing hinging motion. These hinge members give no strength to the mounting of the door. The patentee provides expensive metal caps for the tops and bottoms at the panels to get the needed mounting strength.

Another type of folding door utilizes elongated panels formed with piano type hinges extending the full length of the panels. The pintles for the hinges are longer than the panels, the upper ends carrying rollers and the lower ends extending into a lower guide. This construction is shown in Auten U.S. Pat. No. 2,351,656. Here the folding door is both supported and guided by its hinge pintles. However this construction requires prohibitive expensive individual moulding of the panels.

SUMMARY OF THE INVENTION

The primary object of the invention is to provide a low cost strong folding door in which the panels and hinges are extruded. This object is achieved by a construction which obtains an extra function from the well known double channel hinge member. In addition to holding two adjacent panels together, my hinge members also support and guide both ends of the two panels. This provides strong rigid contact between the hinge members and guides for locating the panels and resisting movement caused by storm forces or break ins.

In the preferred form of my invention, the hinge members are not the same length as the panels as in prior art devices. They are substantially longer than the panels and extend into upper and lower guides. The ends of the hinge member channels are closed by pins carried by bearing members engaging the guides. These pins have the dual function of supporting the hinge members and locating the panels endwise in the hinge members.

The invention also includes end trim locking sections hingedly attached to the panels and being longer than the panels to be guided and supported by the guides.

BREIF DESCRIPTION OF THE DRAWINGS

FIG. 3 is a sectional elevation showing the upper and lower tracks, the hinges, hinge closures-guides in section taken on line 3—3 of FIG. 1.

FIG. 4 is a section taken on line 4—4 of FIG. 3.

FIG. 5 is a side view of a modified hinge closure and guide.

FIG. 6 is a top view of FIG. 5.

FIG. 7 is a sectional view looking down at a shutter assembly having two sections joining in the middle and having an inside lock.

FIG. 8 is a sectional view taken on line 8—8 of FIG. 7, but on a smaller scale.

DESCRIPTION OF THE PREFERRED EMBODIMENTS

Figure 1:
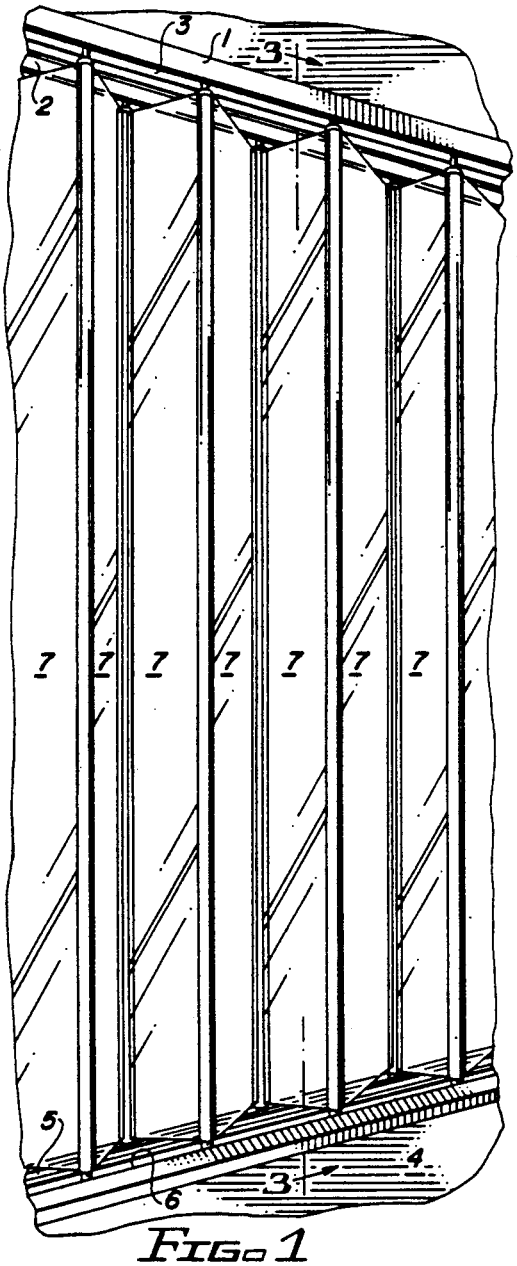
FIG. 1 is a perspective view of a portion of a shutter in closed position.
Figure 2:
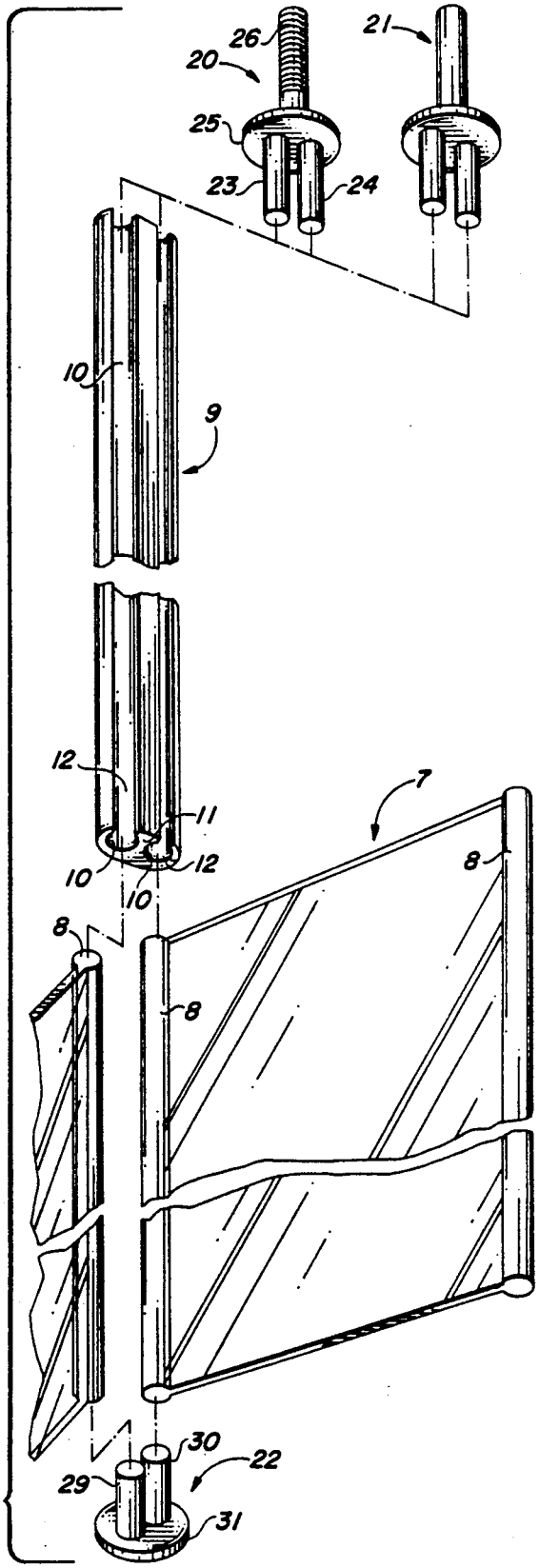
FIG. 2 is a exploded view illustrating the panels, hinges, and combination hinge closures and guides.

Referring first to FIG. 1 the shutter assembly closes an opening having a top 1 supporting an inner track 2 and an outer track 3. The bottom of this opening 4 supports an inside track 5 and an outside track 6. The shutter consists of a group of elongated identical panels 7 extending between the guides. These panels are extrusions of a strong stable plastic such as "LEXAN" and may be transparent or opaque in any color. These panels are preferably flat in their main portions and are formed at opposite edges with circular elongated beads 8 (FIG. 2). These beads have a diameter greater than the thickness of the panels. Beads of adjacent panels are held together in flexing relationship by elongated hinge members 9. These hinge members are formed with two separate circular channels 10. These channels are separated by a web 11 and have openings 12 through which the flat portions of the panels pass. These opeings are proportioned so as to hold the beads of the panels while allowing sufficient angular movement for opening and closing of the shutter.

Referring to FIG. 3, the upper inside guide means or track 2 is "U" shaped having an upper section 13 fastened to the top of the opening and two downwardly extending legs 14 and 15 having inward extensions 16 and 17. These inward extensions support rollers 17 and 18 attached to a yoke 19.

The panels 7 are shorter in length than the distance between the guides 2,3,5, and 6. The hinge members 9 are substantially longer than the panels. The panels are located in the hinge members by closure members or guided means 20 or 21 at their upper ends and by 22 at their lower ends. The closure member 20 includes two downwardly extending pins 23 and 24 (FIG. 2) integral with a disc 25 attached to a screw threaded upward extension 26. The pins 23 and 24 press fit into the slots 10 of hinge members 9, and extensions 26 pass through yokes 19 of the roller assemblies shown in FIG. 3. The etensions are secured in place by nuts 27. Preferably a spacer 28 having a length greater than the thickness of yoke 19 is located between the nuts. This permits a swiveling action between the roller assemblies and the hinge members, avoiding binding.

Alternate hinge members are provided with closure members or guided means 21. These are the same construction as members 20 but have no screw threads and bear against the upper outer guide 3.

The lower ends of the hinge members are closed by closure members or guide means 22 having pins 29 and 30 extending upwardly into slots 10. These closure members have guided discs 31 attached to the pins.

Alternate hinge members 9 extend into lower inside guides 5. These guides have "U" shaped portions 32, the bottom being secured to the sill 33. Upwardly extending legs 34 support rub strips 35 which are engaged by the guided circular sections 31 of closure members 22.

An outside bottom guide 36 is also mounted on sill 33 and supports a rub strip 37 which is engaged by disc 22 of alternate hinge members 9.

FIGS. 5 and 6 are show an alternate construction for the closure members 22. Upward extensions or projections 38 and 39 are spaced from the pins and fit tightly against the outside faces of the hinge members 9, giving added strength. These extensions may of course be provided on all of the closure members.

It should be noted from FIG. 2 that the panels 7 are shorter in length than the distance between the upper and lower guides. This linears space allow them to swivel for opening and closing of the shutter. The hinge members are substantially longer than the panels, extending into the guides and being guided thereby. The closure members serve to prevent direct contact between the hinge members and guides and also locate the panels endwise in the hinge members. This arrangement provides low cost hinging of the panels and utilizes the strength of the hinges to locate the shutter in the guides. The result is a strong low cost shutter giving added security to the user.

FIGS. 7 and 8 show the preferred form of locking means for locking the shutters closed. Reference character 40 indicates an end trim section having a slot 41 receiving the bead 8 of the end panel 7. This trim section is formed including an inside wall 42 and an outside wall 43 receiving an end trim section 44 having a slot 45 receiving the bead 8 of another panel 7. This trim section 44 includes a cross member 47 having an opening (not shown) receiving locking lever 48 mounted on shaft 49 carried by the inside wall 42 of trim section 40. This shaft is operated by a handle 50 for locking and unlocking the end trim sections in a manner well known in the art.

As shown in FIG. 8, the panels are located in the end trim sections by upper and lower closure members 51 and 52. These are similar to closure members 20 and 22 but have a single pin instead of two pins. The outside walls 40 and 44 are notched at 53 and 54 to clear the upper and lower guide members.

The arrangement described is for a two section shutter locking in the middle. For a single section shutter locking at one edge of the opening, the trim section 44 is modified to include mounting flanges 55 and 56 for attaching to the wall. In such installations, the handle 50 is rotated to extend away from the wall.

I claim:

1. A foldable door structure for a space comprising guide means mounted in said space, a plurality of elongated panels extending across said space, said panels being formed with elongated hinge formations on each side, elongated hinge members between adjacent panels connecting the panels in angular movement relationship, said hinge members having separate parallel and alterally spaced engagement portions holding the panel hinge formations, said panels being spaced linearly from the guide means allowing them to swivel for opening and closing the door and said hinge members having individual guided means extending into engagement with and guide by the guided means, the hinge members being longer than the panels, extending beyond the panels at at least one end, the guided means being attached to the hinge members and being arranged to space the panel ends from the ends of the hinge members.

2. The combination recited in claim 1 which the hinge formations on the panel are of male configuration and extend into parallel slots formed in the hinge members.

3. The combination recited in claim 2 which the guided means includes a pair of pins extending ino the ends of the parallel slots in the hinge members.

4. The combination recited in claim 3 which the guided means also includes a projection parallel with and spaced from one of the pins, said projection engaging the outside of its associated hinge member.

5. A foldable door structure for a space, horizontal guide means in the space, a plurality of elongated vertical panels extending across said space, said panels being formed with substantially continuous beads on each side, said beads having a larger diameter than the thickness of the panels, elongated hinge members between adjacent panels connecting the panels in angular movement relationship, said hinge members having elongated slot receiving and holding the beads on the panels, said panels being spaced linearly from the guide means allowing them to swivel for opening and closing the door, said hinge members having individual guided means extending into engagement with and guided by the guide means, the hinge members being longer than the panels and extending beyond the panels at each end, the guided means having pins extending into the slots and spacing ends of the panels from the ends of the hinge members.

6. The combinations recited in claim 5 in which the guided means also includes a projection parallel with and spaced from the pins, said projection engaging the outside of its associated hinge member.

7. The combination recited in claim 5 including an end trim section adjacent an end panel, said trim section having an elongated slot receiving the adjacent bead of said end panel holding the end panel and trim section together in hinged relationship, the portion of the trim section having the elongated slot being longer than the panels, and guided means for the trim section arranged to space an end of said end panel from the adjacent end of the trim section.

8. The combination recited in claim 7 in which the guided means includes a pin extending into the slot and separates the panel from the end of the slot.

9. The combination recited in claim 7 in which the end trim section supports a locking means for locking the door in closed position.

10. A foldable door structure for a space, guide means in said space, a plurality of elongated vertical panels guided by the guide means, said panels having edges hinged together, an end panel for the door having a hinge formation on its outside edge, an end trim section adjacent said end panel hving an engagement portion with the hinge formation on said end panel arranged to hold the end panel and trim section together in hinged relationship, said panels being spaced linearly from the guide means allowing them to swivel for opening and closing the door, said end trim section being longer than the panels and extending into engagement with and guided by the guide means, the hinge formation on the end panel consisting of a bead and the engagement portion of the end trim section consists of a slot receiving said bead.

11. The combination recited in claim 10 in which the end trim section and its slot are longer than the panels, the guided means for said end trim section extending into the slot and arranged to spaced the end panel from the adjacent end of the trim section.

12. The combination recited in claim 11 in which the guided means includes a pin extending into the slot.

13. A foldable door structure for a space, guide means in said space, a plurality of elongated vertical panels guided by the guide means, said panels having edges held together by hinges, an end panel for the door having a hinge formation on its outside edge, an end trim section adjacent said end panel having an engagement portion with the hinge formation on said end panel arranged to hold the end panel and end trim section together in hinged relationship, said end trim section having a general appearance distinguishing it from the panels, and having a relatively flat section with a width greater than its thickness, giving the end of the foldable door structure a finished appearance differing from the panels and hinges, said panels being spaced linearly from the guide means allowing them to swivel for opening and closing the door, said end trim section being longer than the panels and extending into engagement with an guided by the guide means.

14. The combination recited in claim 13 in which the end trim section has a thickness substantially larger than the panels.

15. The combination recited in claim 14 in which the end trim section supports locking means for holding the door closed.

16. The combination recited in claim 15 in which the end trim section supports a handle for releasing the locking means.

* * * * *